US006547111B2

(12) United States Patent
French

(10) Patent No.: US 6,547,111 B2
(45) Date of Patent: Apr. 15, 2003

(54) HANDGUN HOLSTER WITH INTERNAL RETENTION DEVICE

(75) Inventor: John M. French, Boise, ID (US)

(73) Assignee: Michaels of Oregon Co., Oregon City, OR (US)

( * ) Notice: Subject to any disclaimer, the term of this patent is extended or adjusted under 35 U.S.C. 154(b) by 0 days.

(21) Appl. No.: 09/919,975

(22) Filed: Jul. 31, 2001

(65) Prior Publication Data

US 2002/0017541 A1 Feb. 14, 2002

Related U.S. Application Data

(60) Provisional application No. 60/223,256, filed on Aug. 4, 2000.

(51) Int. Cl.[7] ..... F41C 33/02
(52) U.S. Cl. ..... 224/244; 224/911
(58) Field of Search ..... 224/243, 244, 224/245, 911

(56) References Cited

U.S. PATENT DOCUMENTS

| | | | | |
|---|---|---|---|---|
| 1,113,530 A | | 10/1914 | Audley | |
| 1,191,339 A | | 7/1916 | Noye | |
| 1,635,984 A | | 7/1927 | Corriston | |
| 3,645,428 A | | 2/1972 | Angell | |
| 4,256,243 A | | 3/1981 | Bianchi et al. | 224/244 |
| 4,277,007 A | * | 7/1981 | Bianchi et al. | 224/244 |
| 4,846,384 A | | 7/1989 | Perry | 224/244 |
| 4,925,075 A | | 5/1990 | Rogers | 224/244 |
| 5,018,654 A | | 5/1991 | Rogers et al. | 224/244 |
| 5,094,376 A | | 3/1992 | Brauch | 224/243 |
| 5,100,036 A | | 3/1992 | Rogers et al. | 224/244 |
| 5,129,562 A | | 7/1992 | Bianchi | 224/244 |
| 5,150,825 A | | 9/1992 | Nichols | 224/243 |
| 5,275,317 A | | 1/1994 | Rogers et al. | 224/244 |
| 5,284,281 A | | 2/1994 | Nichols | 224/244 |
| 5,395,021 A | | 3/1995 | Brown | 224/244 |
| 5,419,474 A | * | 5/1995 | Marx et al. | 224/244 |
| 5,449,103 A | | 9/1995 | Tilley | 224/244 |
| 5,509,591 A | * | 4/1996 | Carver | 224/244 |
| 5,518,155 A | | 5/1996 | Gallagher | 224/244 |
| 5,573,157 A | | 11/1996 | Mauriello et al. | 224/244 |
| 5,810,221 A | | 9/1998 | Beletsky et al. | 224/244 |
| 5,846,384 A | | 12/1998 | Schöld et al. | |
| 5,855,305 A | * | 1/1999 | Nichols | 224/244 |
| 5,944,239 A | | 8/1999 | Rogers et al. | |
| 5,961,013 A | * | 10/1999 | Collins | 224/244 |

OTHER PUBLICATIONS

J.M. Bucheimer Co., Inc. 1985–86 Catalog, 3 pages.

* cited by examiner

*Primary Examiner*—Nathan J. Newhouse
(74) *Attorney, Agent, or Firm*—Stoel Rives LLP

(57) ABSTRACT

A handgun holster has a body that includes inner and outer sides. A catch projects into a handgun receiving pocket toward the inner side. The catch extends within and engages the trigger guard of a handgun carried in the pocket, preventing the handgun from being removed from the pocket. A guide plate is moveable away from the end of the catch in response to outward pressure, to provide clearance for the trigger guard to pass by the catch so that the handgun can be removed from the holster only when the handgun is manipulated appropriately by the wearer. The catch includes a cam surface mounted on a mounting plate so that the trigger guard will slide past the catch when the handgun is placed into the holster. The guide plate and mounting plate cover extend past the rear of the trigger of the holster so as to prevent accidental contact with the trigger.

16 Claims, 4 Drawing Sheets

HANDGUN HOLSTER WITH INTERNAL RETENTION DEVICE

This application claims the benefit of priority of provisional Patent Application Serial No. 60/223,256 filed Aug. 4, 2000.

BACKGROUND OF THE INVENTION

The present invention relates to a holster and more particularly to a handgun holster with an internal retention device for securely latching a handgun in the holster until its removal is desired by the holster wearer.

Handgun users, particularly those people engaged in law enforcement, require a holster in which a handgun remains securely held until intentionally removed by the holster wearer. The holster must retain the handgun securely during not only the normal movements of the wearer, but also during more vigorous activity; possibly including physical contact such as when attempting to restrain another person or while being attacked by another person. But while the holster should resist unauthorized removal of the handgun, it should also permit rapid, safe and easy withdrawal of the handgun when its use is required by the holster wearer.

The recent popularity among law enforcement agencies and personnel of handguns having a striker-type firing mechanism presents a unique challenge to holster design. Striker-type handguns do not have external hammers. Consequently, conventional holster designs using an external retention strap to secure a handgun that employs an external hammer do not necessarily prevent a striker-type handgun from discharging unintentionally when holstered. This is because the retention strap, when secured across the top of a holstered handgun with an external hammer, will prevent the hammer from moving and, thus, will likely prevent the gun from discharging, but when the strap is secured across the top of a hammerless handgun, discharge may still occur because the strap has no hammer to secure and, thus, does not operate to prevent the discharge.

Furthermore, handguns having a striker firing mechanism generally require a lesser force to pull the trigger and fire the weapon than is generally associated with many other types of law enforcement handguns. this lesser force, often combined with a shorter trigger stroke, contributes to the ease of intentional firing when needed and the possibility of unintentional firing when holstered.

Because striker-type handguns are being used more widely by law enforcement, holster design must evolve to better meet the needs of users of hammerless handguns. The vigorous activity engaged in by law enforcement officers, including close-quarter confrontation with suspects, establishes the need for a holster design that can retain a hammerless handgun safely while both allowing the officer quick access to his weapon and minimizing the chance of inadvertent discharge when holstered.

Therefore, what is needed is a holster having an internally located retention device that accomplishes multiple functions for the user. First, it should permit a holstered handgun to be withdrawn in a natural motion by the holster wearer. Second, it should effectively resist unauthorized withdrawal of the handgun from the holster by another person. Third, it should protect the trigger area of the handgun from intrusion by objects, such as knives or other weapons that might be used against the officer, and by the fingers of a third person, either of which could cause the handgun to discharge while still holstered.

BRIEF SUMMARY OF THE INVENTION

The present invention meets the design challenges presented by hammerless handguns by improving upon the retention systems utilized in previously available holsters by providing a handgun holster with an internal retention device which prevents the handgun from being removed from the holster until after a slight rotation of the gun about an axis generally parallel with the barrel of the handgun, and which further includes a restricted access to the trigger. A holster according to the invention has a body which includes outer and inner sides which are interconnected, possibly by a spacer or similar interconnecting structure, to define the rear portion of an upwardly open or openable pocket for receiving a handgun including a trigger guard. A catch is attached to the outer side and projects within the pocket toward the inner side, the side closer to the holster wearer's body. The catch is located where it will be engaged with the trigger guard when the handgun is fully holstered and is configured and mounted so that attempting simply to pull the handgun directly from the holster does not allow the trigger guard to pass the catch. A guide plate is close enough to the outer side to keep the trigger guard engaged with the catch, securing the handgun within the holster. The guide plate, however, is movable away from the end of the catch to provide clearance, at least as great as the lateral width of the trigger guard, for passage of the trigger guard past the catch to remove the handgun from the holster. The guide plate extends past the rear of the trigger of the handgun.

When a handgun is inserted into the holster, the guide plate is forced temporarily away from the end of the catch as the trigger guard moves past the end of the catch, and the trigger guard moves to extend around the catch as the handgun is seated in the holster.

Preferably, the catch is mounted on a mounting plate, which also extends past the rear of the trigger of the handgun.

By covering the trigger of the handgun with the guide plate, and optionally with the mounting plate as well, the trigger is covered so as to prevent a foreign object from coming into accidental contact with the trigger. In a preferred embodiment, the guide plate and mounting plate extend to the upper margin of the holster body.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
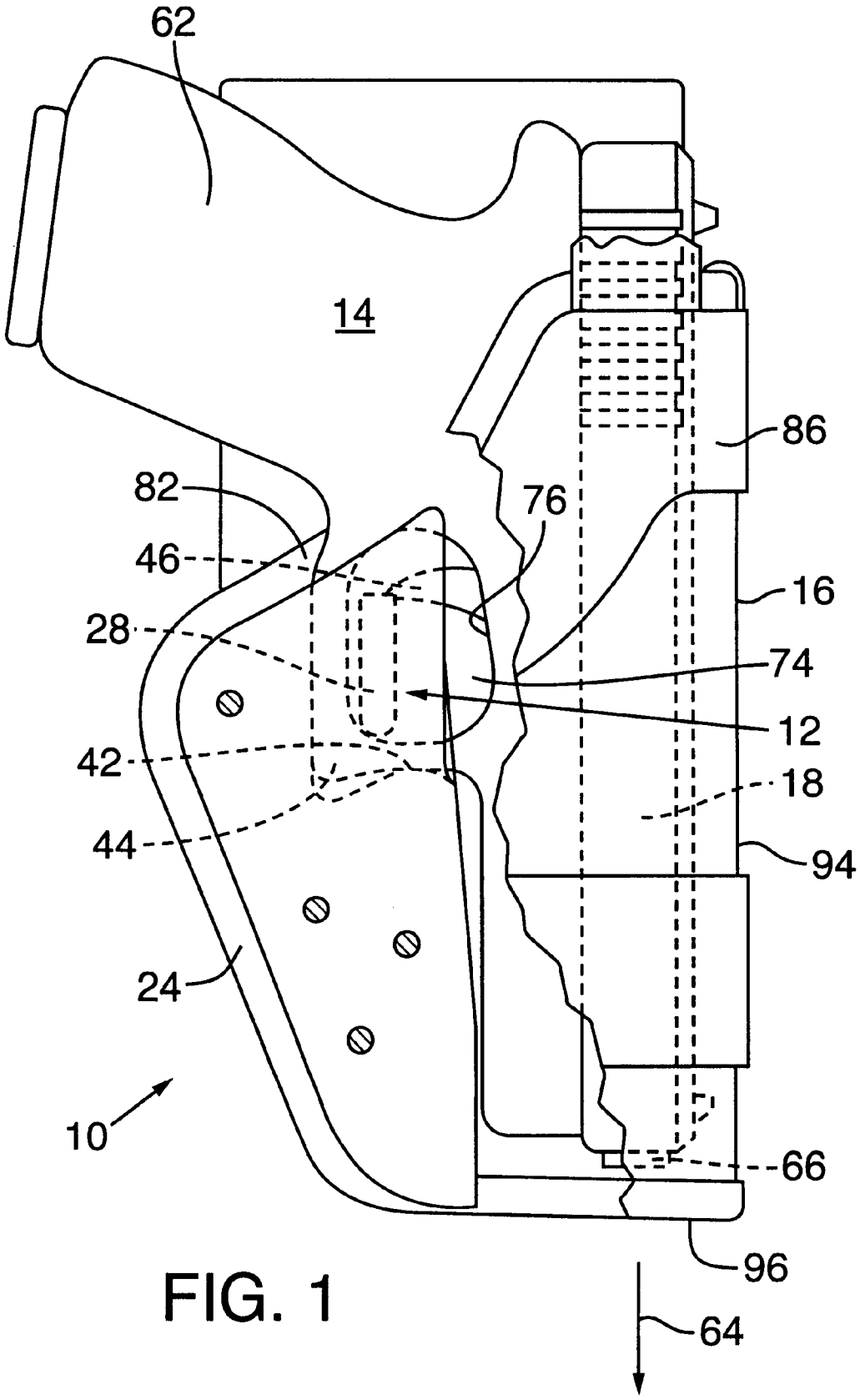
FIG. 1 is a partially cut-away outer side elevation view of a holster, together with a handgun held in the holster by an internal retention device of the present invention.
Figure 2:
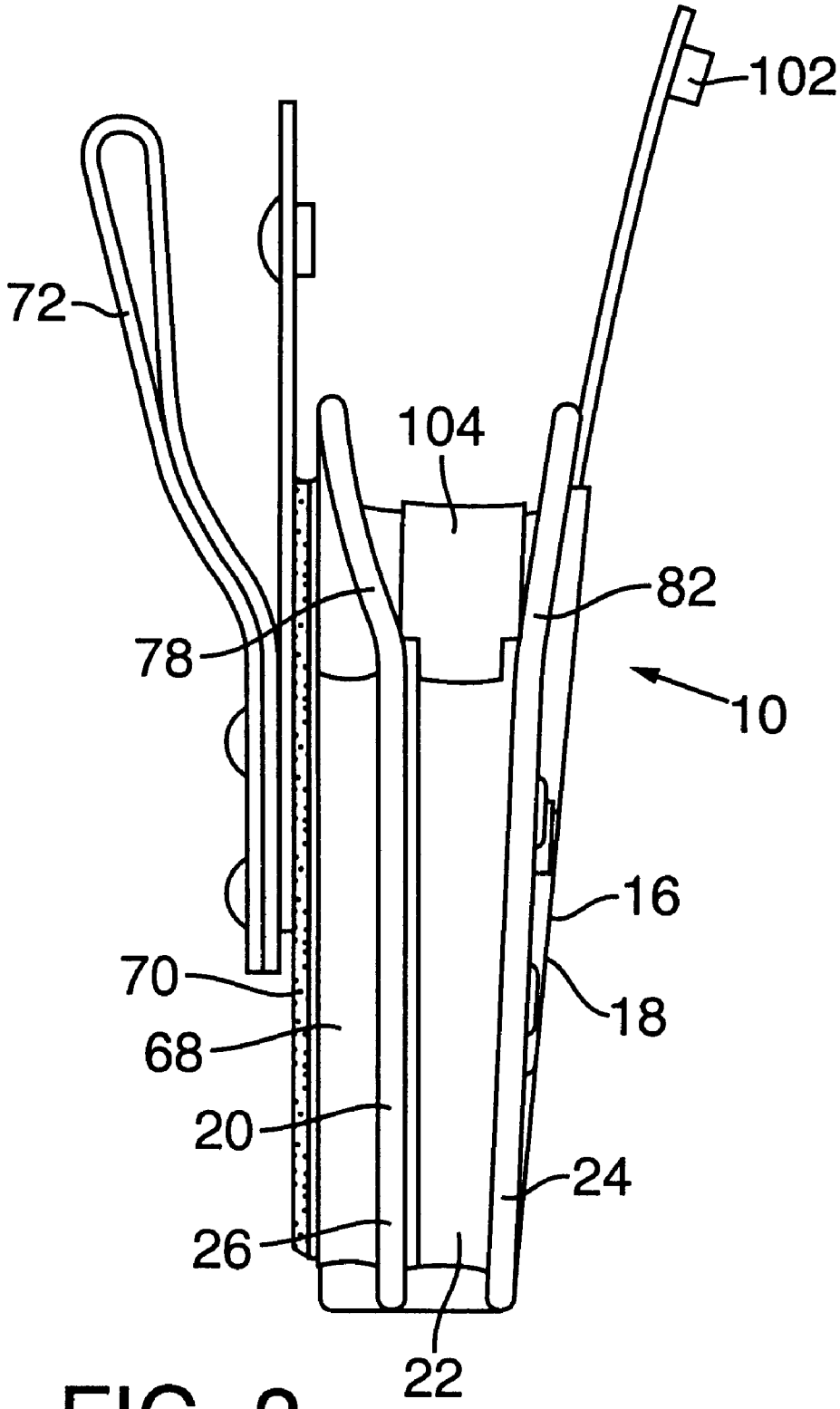
FIG. 2 is a rear elevational view of the holster shown in FIG. 1 without the handgun.
Figure 3:
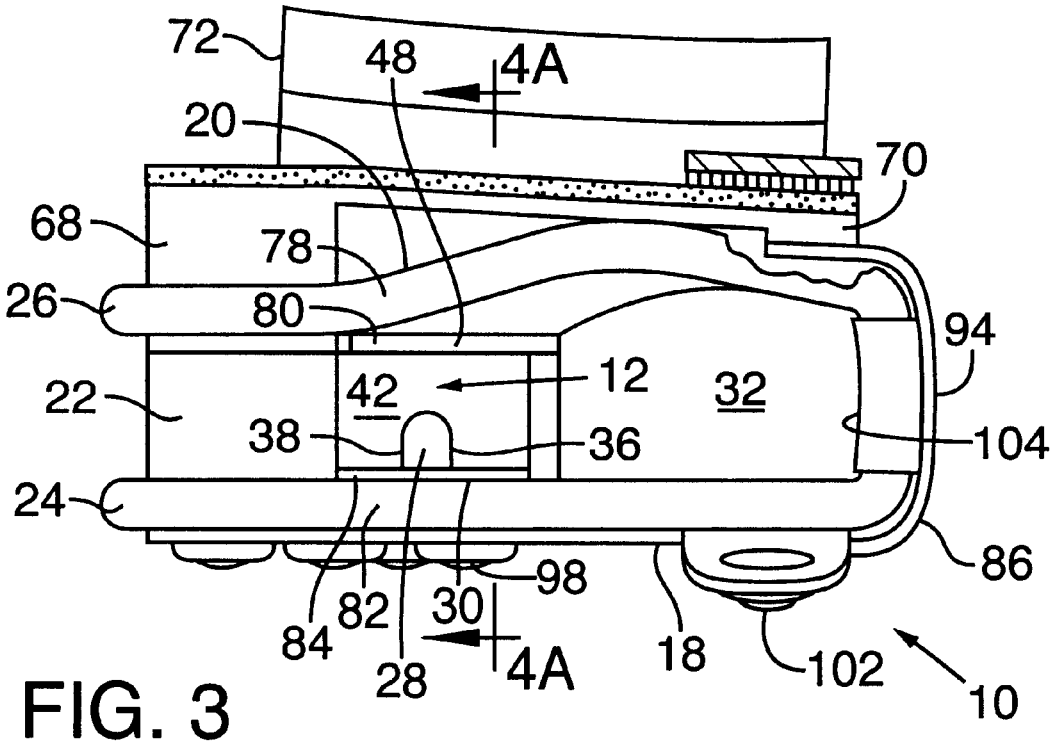
FIG. 3 is a top plan view of the holster shown in FIG. 1.

Referring now to the drawings, FIGS. 1–5 show a holster 10 embodying the present invention. An internal retention device 12 is included in the holster 10 for holding a handgun 14 securely in the holster 10 and preventing undesired withdrawal. A body 16 of the holster 10 includes an outer side 18 and an inner side 20 interconnected by a connecting portion such as a spacer 22 located between the respective rear margins 24 and 26 of the outer side 18 and inner side 20. A catch 28 mounted on a mounting plate 30 is associated with the outer side of the holster body, where it projects into a handgun-receiving pocket 32 of the holster 10 and extends toward the inner side 20.

The catch 28 includes an obliquely inclined upper cam surface 34 facing upward and toward the inner side 20 of the handgun-receiving pocket and extending to the end 29 of the catch 28, which is directed toward the inner side 20 of the holster 10. Front and rear surfaces 36 and 38 of the catch 28 extend laterally of the holster 10, generally normal to the outer side 18, as does a downwardly convex cylindrical bottom surface 40 of the catch 28. The spacer portion 22 of the connecting portion has an upper or inner surface 42, located beneath the catch 28, which defines a trigger guard position between the rear portions of the inner side 20 and outer side 18. This provides room for the trigger guard beneath the catch 28, but prevents a handgun from being urged into the holster so far that it could be discharged by pressure of the catch itself against the trigger 46 within the trigger guard 44.

Figure 5:
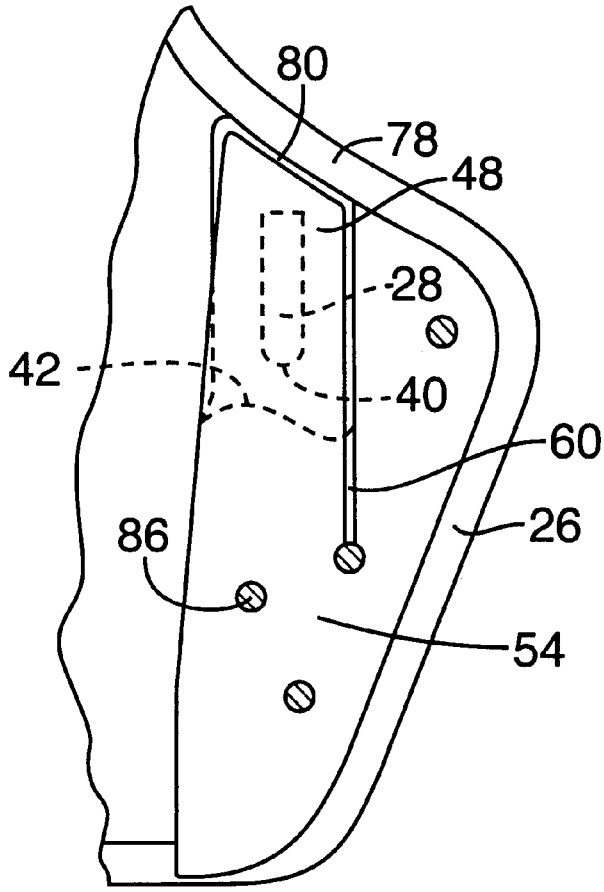
FIG. 5 is a view similar to that of FIG. 1, viewed from the opposite side and with additional elements cut away, and without the handgun in the holster.
Figure 4A:
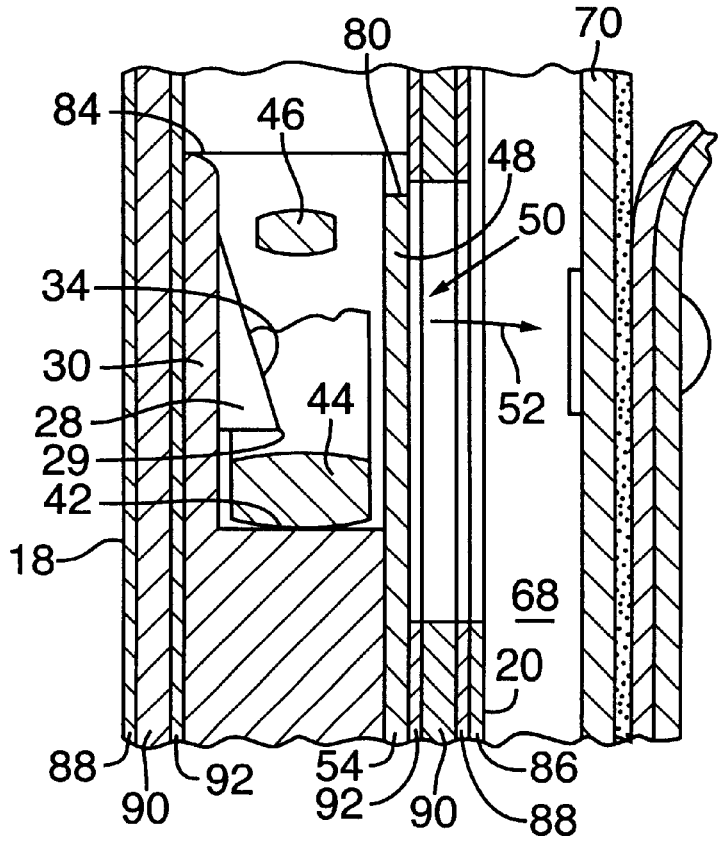
FIG. 4A is a sectional detail view of the holster shown in FIG. 1 taken in the direction of line 4—4 of FIG. 3 and showing the catch used to retain a handgun within the holster.
Figure 4B:
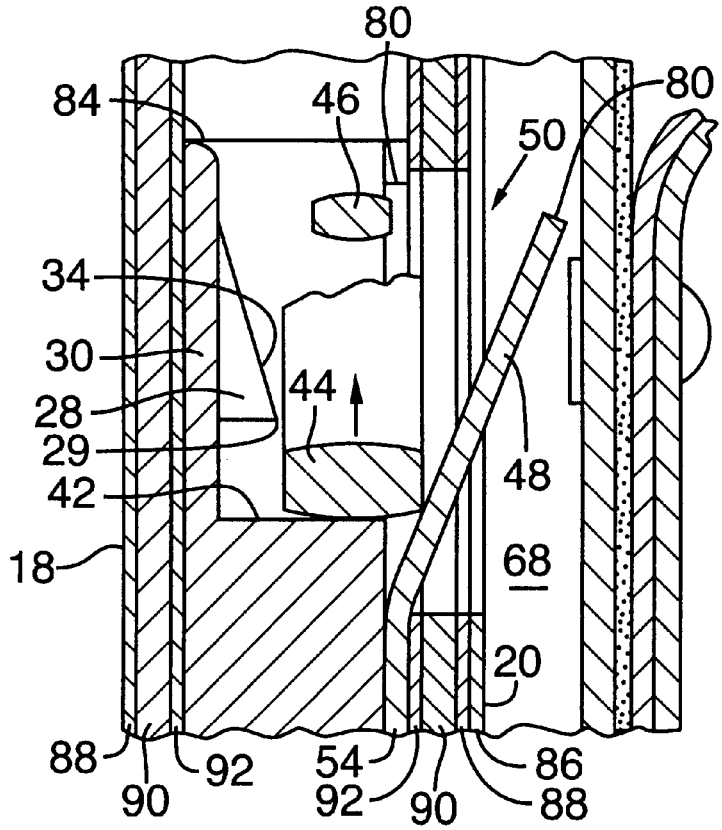
FIG. 4B is a view similar to that of FIG. 4A, showing a movable portion of the guide plate displaced to permit removal of a handgun from the holster.

A movable guide plate 48 of stiff yet resilient sheet material is located within the handgun-receiving pocket 32 of the holster 10. A small portion of the material forming the inner side 20 is cut away, forming an opening 50, to leave room for the guide plate to be moved resiliently outward, away from the interior of the handgun-receiving pocket 32, as indicated by the arrow 52. This provides clearance for passage of the trigger guard 44 toward the wearer of the holster far enough for the trigger guard 44 to clear the end of the catch 28. The guide plate 48 is preferably formed integrally as a part of a plate 54 lying between the connecting portion 22 and the inner side 20 of the holster. As shown in FIG. 5, the movable guide plate 48 is preferably defined by a slot 60. As the handgun is pushed downward the trigger guard rides along the catch 28, and by camming action forces the guide plate 48 to bend resiliently away from the interior of the handgun-receiving pocket of the holster, into the opening 50, until the trigger guard 44 passes the end 29 of the catch 28. Once the trigger guard passes the end 29 of the catch 28, the guide plate 48, by its elastic restoring forces, urges the trigger guard 44 laterally toward the outer side 18 and under the catch 28, which then prevents the handgun from being removed from the holster.

For removal of a handgun from the holster, the butt end of the grip 62 of the handgun 14 is urged inward toward the wearer. This movement rotates the handgun 14 slightly toward the wearer about an axis 64 generally parallel with the bore of the barrel 66 of the handgun, bringing the trigger guard 44 into contact with the guide plate 48 and forcing the guide plate 48 away from the end 29 until clearance is available for the trigger guard to be moved past the end 29. The handgun may then be withdrawn upward from the handgun-receiving pocket 32, in a direction parallel with the axis 64 of the bore of the barrel.

A space is provided outside the handgun-receiving pocket for movement of the guide plate 48 laterally away from the catch 28 toward the holster wearer, by a spacer 68 which is preferably formed integrally with a backing plate 70 to which a belt loop 72 is attached. The backing plate may be made, for example, of a rigid plastic such as nylon, ABS or polystyrene.

The present invention provides the advantage of shielding the trigger area 74 of the handgun when the handgun is holstered. The trigger area 74 of the handgun is defined by the open space enclosed by the trigger guard 44 and the portion 76 of the holster surrounding the trigger. The guide plate 48 is extended so as to cover a substantial portion of the inner side of trigger area 74 of the handgun when the handgun is holstered, and in particular to extend past the rear of the trigger. Accordingly, the guide plate 48 is formed so that, when the handgun is in the holster, the guide plate 48 extends at least past the rear of the trigger. The guide plate 48 thus eliminates access to the trigger while the handgun is secured in the holster. In a preferred embodiment, the guide plate 48 extends from the upper surface 42 of the spacer beneath the catch 28 up to the upper margin 78 of the inner side 20 of the holster, so that the top surface 80 of the guide plate is adjacent to the upper margin. In addition, the guide plate 48 is substantially straight and planar along its entire length so that it is in close proximity to the trigger area 74 of the handgun. Preferably, the guide plate 48 has a thickness of 3⁄16 inch, or about 5 mm. The top surface 80 of the guide plate 48 that is exposed to the exterior of the holster is preferably flat, with squared edges between the top surface 80 and the side surfaces of the guide plate, so that the top surface is oriented substantially transversely to the inner side 20. The guide plate covers as much of the trigger area as possible, preferably at least a major portion of the trigger area.

Similarly, the outer side of the trigger area 74 of the handgun is preferably protected by the mounting plate 30. The mounting plate 30 is extended so as to cover the trigger area 74 of the handgun when the handgun is holstered. Accordingly, the mounting plate 30 is formed so that, when the handgun is in the holster, the mounting plate 30 extends past the rear of the trigger of the handgun. The mounting plate 30 thus eliminates access to the trigger while the handgun is secured in the holster. In a preferred embodiment, the mounting plate 30 extends from the upper surface 42 of the spacer 22 beneath the catch 28 up to the upper margin 82 of the outer side of the holster so that the top margin 84 of the mounting plate is adjacent the upper margin 82. In addition, the mounting plate 30 is substantially straight and planar along its entire length so that it is in close proximity to the trigger area 74 of the handgun. Preferably, the mounting plate 30 has a thickness of about 3⁄16 inch, or about 5 mm. The top margin 84 of the mounting plate 48 that is exposed to the exterior of the holster is preferably slightly beveled, so that the handgun 14 may slide easily into the holster along the mounting plate 30 before coming into contact with the catch 28. The mounting plate covers as much of the trigger area as possible, preferably at least a major portion of the trigger area.

Together, the guide plate 48 and mounting plate 30 enclose at least a substantial portion of the trigger area 74 of the handgun so as to protect the trigger 46 from accidental contact with foreign objects. The squared, top surface 80 of the guide plate 48 further restricts access to the trigger area. Nevertheless, while the guide plate 48 and mounting plate 30 protect the trigger area, they do not interfere with the functioning of the internal retention device 12 or the withdrawal of the holster. The guide plate and mounting plate are useful not only for handguns having the striker firing mechanism, but also for handguns having conventional hammer firing mechanisms.

The present invention may be utilized in any holster in which it is desired to include such an internal retention device 12. Details of the construction of one such holster are disclosed in Marx, U.S. Pat. No. 5,419,474, which is herein incorporated by reference in its entirety.

In a preferred embodiment, the holster body 16 includes a frame 86 surrounding and supporting the outer side 18 and inner side 20. The frame 86 is a thin sheet of a suitably stiff, resilient, tough, and yet somewhat flexible material (such as a copolymeric mixture of polyvinylchloride and polyacrylic plastic material available from Kleerdex Company of Mt. Laurel, N.J., under the trademark "Kydex"), which is cut to the desired shape.

In the embodiment of the invention shown, the outer side 18 and inner side 20 are constructed of a multi-layered, resilient, laminated sheet material, including an outer layer 88, an intermediate layer 90, and an inner layer 92. The outer layer is a sturdy, wear-resistant, strong material such as a 1000-denier woven nylon cloth, and the inner layer is preferably a softer, non-abrasive material such as a 430-denier smooth-surfaced nylon pack cloth, although the layers 88 and 92 might be of other materials, including leather. The intermediate layer 90 is a compressible resilient material, for example, a synthetic polymeric foam such as an open-cell polyethylene foam having a density of 9–15 pounds per cubic foot and having a thickness 44 of about ¼ inch when relaxed. Other resilient materials such as closed cell foam could also be used.

The outer layer 88, intermediate layer 90, and inner layer 92 are interconnected by thermal welding or adhesives (not shown). The laminated material is bent to form roughly a "U" shape as seen from above the holster 10, defining a front 94, a bottom 96, the outer side 18, the inner side 20, and their respective rear margins 24 and 26, and generally diagonal respective upper margins 82 and 78.

Although such a construction is not shown, it is also contemplated that a structure similar to the frame could be incorporated between layers of the laminated material, instead of extending about the outside of the laminated material. For example, such a structure could be located between a pair of thinner layers of compressible, resilient foam material replacing the intermediate layer 40.

An adjustable fastener such as a clamp bolt 96 may extend through an area of the outer side portion of the frame and through corresponding portions of the outer side, the connecting spacer, and the inner side 20 of the body 16. The adjustable fastener permits adjustment of the holster 10 to receive a particular handgun snugly, by adjusting the spacing between portions of the sides 18 and 20 and adjusting the degree to which the frame 86, and particularly its lower horizontal band, compresses the inner side 20 and outer side 18, especially the intermediate layer 90 of each, against the handgun.

A belt loop 100 is attached to the inner side portion of the frame 86. A thumb break 102 is attached adjustably to the inner side portion 86 of the frame 36. A security strap 104 is attached to the outer side 18 of the body and may be secured detachably to the thumb break 102 by a fastener such as a snap to hold the handgun securely in the holster when need to use the handgun is not imminent. It is to be understood, however, that the retention device of the present invention still provides security for the handgun when the thumb break and security strap are separated.

Preferably, a ribbon-like spine strip 104 of tough, flexible, somewhat slippery material such as sheet polyurethane is sewn to the top and bottom margins of the handgun-receiving pocket of the holster, and extends vertically along the interior of the front portion. This guards the fabric of the interior layer of the handgun-receiving pocket against being torn by the sight of a handgun, and protects the sight blade of a handgun against abrasion during drawing or replacement of a handgun within the pocket.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A handgun holster for securely holding a handgun including a trigger and a trigger guard, the holster comprising:

(a) a holster body including an outer side and an inner side each having a respective rear portion, a respective rear margin and a respective upper margin;

(b) spacer means for spacing apart said rear portions and defining a trigger guard position above said spacer means and between said rear portions;

(c) a catch located in a fixed position with respect to said outer side and having an end projecting toward said inner side, within said trigger guard position and proximate said spacer means;

(d) a guide plate located opposite said catch and defining a trigger guard path between said catch and said rear portion of said inner side, said guide plate normally being located in a first position closer to said end of said catch and being movable to a second position spaced further from said end of said catch for preventing the trigger guard from moving past said end of said catch while said guide plate is located in said first position; and (e) resilient means for urging said guide plate toward said first position; and (f) said guide plate having a top surface adjacent said upper margin of said inner side so as to extend past the rear of the trigger of said handgun.

2. The holster of claim 1 wherein said guide plate is planar along its entire length.

3. The holster of claim 1 wherein said top surface is oriented substantially transversely to said inner side.

4. The holster of claim 3 wherein said top surface extends across the entire width of said guide plate.

5. The holster of claim 1 wherein said inner side defines an opening, said guide plate being movable resiliently away from said catch into said opening.

6. The holster of claim 1 wherein said catch is mounted on a mounting plate having a top margin adjacent said upper margin of said outer side.

7. The holster of claim 6 wherein said mounting plate is substantially planar along its entire length.

8. The holster of claim 3 wherein said catch is mounted on a mounting plate having a top margin adjacent said-upper margin of said outer side and said mounting plate is substantially planar along its entire length.

9. In combination with a handgun having a trigger guard and a trigger area, the trigger guard having a radial thickness and a lateral width, a handgun holster for securely holding a handgun, the holster comprising:

(a) a holster body including an outer side having a rear portion and an inner side having a rear portion;

(b) connecting means for interconnecting said rear portions and partially defining an upwardly open pocket for receiving said handgun so that said trigger guard is located between said outer and inner sides;

(c) a catch associated with said outer side and having an end projecting toward said inner side to a position spaced apart from said inner side by a distance less than said lateral width, said catch being located within said pocket and proximate said connecting means but spaced apart therefrom by a distance at least equal to said radial thickness;

(d) a guide plate being resiliently movable away from said end of said catch to provide clearance, between said end and said guide plate, at least as great as said lateral width, for passage of said trigger guard past said catch when said guide plate is moved away from said end of said catch, and means for urging said guide plate continuously back toward the outer side; and (e) said guide plate extending past the rear of the trigger area of said handgun.

10. The holster of claim 9 wherein said guide plate covers at least a major portion of said trigger area.

11. The holster of claim 9 wherein said guide plate is planar along its entire length.

12. The holster of claim 9 wherein said guide plate has a top surface that is oriented substantially transversely to said inner side.

13. The holster of claim 12 wherein said top surface extends across the width of said guide plate.

14. The holster of claim 9 wherein said inner side defines an opening, said guide plate being movable resiliently away from said catch into said opening.

15. The holster of claim 9 wherein said catch is mounted on a mounting plate that extends past the rear of the trigger of said handgun.

16. The holster of claim 15 wherein said mounting plate has a top margin adjacent to an upper margin of said outer side.

* * * * *